United States Patent [19]

Koizumi

[11] 4,338,386

[45] Jul. 6, 1982

[54] MULTIPLE REPRODUCTION PROCESS AND APPARATUS INVOLVES TONED ELECTROPHOTOGRAPHIC IMAGE TRANSFER

[75] Inventor: Yutaka Koizumi, Kawasaki, Japan

[73] Assignee: Ricoh Company, Ltd., Tokyo, Japan

[21] Appl. No.: 188,350

[22] Filed: Sep. 18, 1980

[30] Foreign Application Priority Data

Sep. 18, 1979 [JP] Japan ..... 54-119767

[51] Int. Cl.[3] ..... G03G 13/16

[52] U.S. Cl. ..... 430/49; 430/303; 430/126; 118/644; 118/649; 118/651; 118/652; 101/468; 101/DIG. 13

[58] Field of Search ..... 430/99, 126, 31, 302, 430/49; 118/644, 651; 101/DIG. 13, 468; 418/649

[56] References Cited

U.S. PATENT DOCUMENTS 3,775,115 11/1973 Sorkin ..... 430/49

3,869,285 3/1975 Kondo et al. ..... 430/49

4,074,009 2/1978 Sanders ..... 430/49 X 4,078,927 3/1978 Amidon ..... 430/49 X

*Primary Examiner*—John D. Welsh

*Attorney, Agent, or Firm*—Guy W. Shoup; Gerard F. Dunne

[57] ABSTRACT

A toner image is formed on a photosensitive member by going through an electrophotographic process including charging, an original image exposure, and developing. The toner image on the photosensitive member is then transferred onto an image retention medium. Thus transferred toner image is temporarily fixed to the image retention medium by the application of heat, thereby enabling to make multiple copies by applying ink to the fixed toner image to form an ink image and bringing a copy paper in contact with the image retention medium for receiving the ink image. The toner image fixed to the image retention medium is completely removed after use thereby preparing the image retention medium for the subsequent use.

24 Claims, 12 Drawing Figures

MULTIPLE REPRODUCTION PROCESS AND APPARATUS INVOLVES TONED ELECTROPHOTOGRAPHIC IMAGE TRANSFER

BACKGROUND OF THE INVENTION

1. Field of the Invention

This invention relates to a process and apparatus for making multiple copies, and more particularly, to a multiple reproduction process and apparatus in which a toner image formed by an electrophotographic technique is transferred onto and temporarily fixed to an image retention medium in order to carry out a multiple reproduction or printing operation with high efficiency.

2. Description of the Prior Art

It is often desired to make multiple copies from a single original. The customary electrophotographic process may be repetitively applied for this purpose, but this is not advantageous, especially for a large number of copies, because it requires the expenditure of a relatively large amount of time per copy. One conventional technique, which is widely used these days, to cope with this problem is to make a master plate with the application of an electrophotographic process and then to set this master plate in an offset printing machine, thereby implementing a multiple reproduction operation. This technique presents some improvements since it does not require the repetitive application of an electrophotographic process in making multiple copies. However, this technique still suffers from various disadvantages. For example, in accordance with this technique, making of a master plate and multiple printing are two separate operations, which requires the provision of two separate machines, i.e., an electrophotographic machine for making a master plate and an offset printing machine for making multiple copies. Therefore, it is disadvantageous because it occupies an unnecessarily large space for installation of the machines. Another disadvantage is the cumbersomeness in making and setting a master plate as a preparatory step for multiple reproductions. This technique is also economically disadvantageous because a master plate is discarded after use and it is not used repetitively.

Another conventional technique is to use the silver salt process, or silverprint method in making a master plate instead of an electrophotographic process. It is true that a master plate provided by this technique has a higher abrasive-resistance property and an image formed on the master plate is better in quality. However, as easily understood, this technique is no more advantageous than the one described above. Moreover, a master plate to be made in accordance with this technique is more expensive, and the handling of the master plate is more cumbersome because it is photosensitive.

Still another conventional technique is the use of a master paper having thereon a silicon resin layer. That is, in accordance with this technique, a toner image is first formed on a ZnO paper. Then the toner image together with the ZnO layer is transferred onto a master paper with the application of heat. The thus formed master paper is used for multiple reproductions with the use of a hydrophilic ink. The cost of this technique is prohibitive since it requires the preparation of ZnO paper as well as master paper. It will be easily understood that the principle of this technique is not much different from the other prior art methods as discussed above.

Meanwhile, Buchan et al. U.S. Pat. No. 3,923,392 issued Dec. 2, 1975 suggests another approach in making multiple copies. In this patent, there is shown an electrophotographic copier which includes a transfer and fusing system and a paper transport system. These systems are operatively associated with the rotation of a photoconductive drum. Thus, an electrostatic latent image formed on the surface of the photoconductive drum is developed by a unique developing unit and, then, the developed image is transferred to an elastomeric transfer belt. Thereafter, the image on the transfer belt is subjected to radiant heat and then finally transferred onto a copy paper. It is to be noted, however, that the transfer belt is always kept in contact with the photoconductive drum. Therefore, in making multiple copies, the latent image still remaining on the photoconductive drum must be developed and the developed image must be transferred to the transfer belt. However, since the latent image decays with respect to time and it deteriorates because of its use, the bias voltage at the developing unit must be increased for compensation. Or, another exposure might have to be carried out after making several copies because of the severe deterioration of the latent image. This conventional technique is also disadvantageous from a energy-saving viewpoint since the photosensitive drum must be kept rotating during the multiple reproduction operation.

SUMMARY OF THE INVENTION

It is therefore an object of this invention to provide a multiple reproduction process and apparatus, enabling to produce excellent quality copies and to produce multiple copies of uniform quality.

Another object of the present invention is to provide a multiple reproduction process and apparatus, enabling to carry out a high-speed multiple copy operation.

A further object of the present invention is to provide a multiple reproduction process and apparatus, enabling to lower power consumption and maximum power requirements than are normally required for high-speed multiple copies.

A still further object of the present invention is to provide a multiple reproduction process and apparatus, enabling to use an image retention medium repetitively thereby increasing economical performance.

A still further object of the present invention is to provide a multiple reproduction process and apparatus in which a toner image is temporarily fixed to an image retention medium thereby enabling the use of the thus fixed toner image as many times as desired without decay or deterioration.

A still further object of the present invention is to provide a multiple reproduction process and apparatus in which a toner image can be fixed to or removed from an image retention medium simply by the application of heat.

A still further object of the present invention is to provide a multiple reproduction apparatus which is simple in structure and easy in manufacture as well as in maintenance.

Other objects, advantages and novel features of the present invention will become apparent from the following detailed description of the invention when considered in conjunction with the accompanying drawings.

DESCRIPTION OF THE PREFERRED EMBODIMENTS

Figure 1:
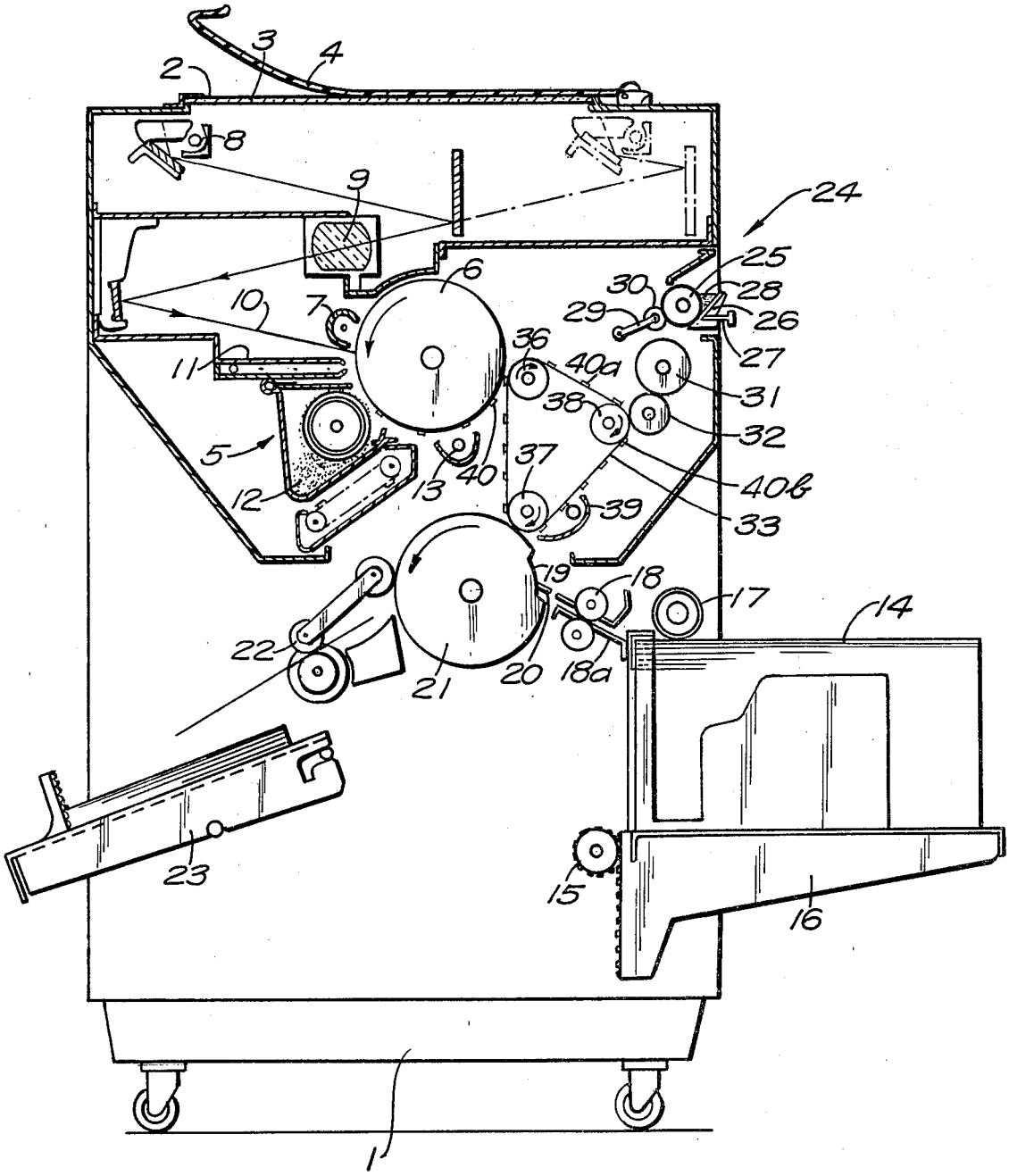
FIG. 1 is a front elevational view of an apparatus incorporating an illustrative embodiment of the present invention.

Referring now to FIG. 1, on top of a machine housing 1 is positioned an original support 3 of transparent glass, on which an original 2 is placed. An original holder 4 is also provided to keep the original 2 in place. Below the original support 3 is disposed a well-known electrophotographic device 5 which comprises a photosensitive drum 6 rotatably supported by the machine housing 1. Around the peripheral surface of the drum 6 are disposed a main charger 7, an exposure system 10 including an exposure lamp 8 and a lens 9, a correction unit 11, a developing unit 12 and a whole surface exposure lamp 13. Therefore, as the drum 6 rotates as indicated by the arrow, the surface of the drum 6 is uniformly charged by the main charger 7 and an original image is exposed onto the charged surface of the drum 6 by the exposure system 10, thereby selectively discharging the surface of the drum 6 in accordance with the image of the original 3 to form an electrostatic latent image. The correction unit 11 is comprised of a plurality of lamps arranged in a line across the peripheral surface of the drum 6. The lamps of the correction unit 11 are selectively operated to remove undesired charges on the drum 6, for example, in the event that the original 3 is smaller areawise as compared with the peripheral surface of the drum 6. Upon correction, the latent image is developed by the developing unit 12 to form a toner image 40. The developing unit 12 shown in FIG. 1 is a magnet brush type, but the present invention should not be limited to this type of developing unit. Finally, the drum surface bearing thereon the toner image 40 is irradiated by the lamp 13, whereby the remaining charge on the drum surface dissipates.

At bottom right of the machine housing 1 is disposed a copy paper support 16 which is supported to be vertically movable. As shown in FIG. 1, one side of the copy paper support 16 is provided with teeth which are engageable with a gear 15. The gear 15 is driven to rotate in synchronism with the paper feeding operation to move the support 16 upward. A plurality of sheets of copy paper 14 are stacked on the support 16 and the top most sheet is in abutment against a feed roller 17. There is defined a paper feeding path 18*a* in the neighborhood of the paper feed roller 17, and a registration roller 18 is disposed in the path. A paper transport drum 21 is rotatably provided at the end of the paper feeding path 18*a*. The drum 21 is provided with a recess 19 in which a clamper 20 is mounted. Therefore, when the top most copy sheet is advanced by the feed roller 17, it moves along the path 18*a*. And, when the leading edge of the advancing sheet hits the registration roller 18, an electrical signal is generated. In association with this signal, the clamper 20 is operated to clamp the leading edge of the copy sheet, and, then, the drum 21 starts to rotate in the direction as indicated by the arrow. Accordingly, the copy sheet is conveyed as riding on the peripheral surface of the drum 21. Upon rotation of the drum 21 over a certain angle, the leading edge of the copy sheet is released and the copy sheet is picked off by a discharge roller unit 22 to be transported to a tray 23.

An inking unit, generally indicated by a numeral 24, is provided above the copy paper support 16. The inking unit 24 includes a pick-up roller 25 and a reservoir 26 containing a supply of ink 28. A screw 27 is also provided with its end abutted against the reservoir 26 so that the amount of ink 28 picked up by the pick-up roller 25 can be manually adjusted. In the neighborhood of the pick-up roller 25 is disposed a pivotal arm 29, and a transfer roller 30 is rotatably supported at the free end of the arm 29. Since the arm 29 pivots to alternate the transfer roller 30 between the pick-up roller 25 and an oscillating roller 31, the ink picked up by the pick-up roller 25 is transferred to the oscillating roller 31. There is also provided an application roller 32 which is in contact with the oscillating roller 31 to receive ink. As will be described later, the application roller 32 is movably supported so that its position may be changed in a predetermined manner inside the machine housing 1.

In accordance with the present invention, there is also provided an image retention medium 33, which takes the form of an endless belt, as one embodiment, at the location surrounded by the photosensitive drum 6, the paper transport drum 21 and the inking unit 24. The image retention belt 33 is extended around three suspension rollers 36, 37 and 38, at least one of which is synchronously driven to rotate in the direction indicated by the arrows. As will become apparent later, all the rollers 36, 37 and 38 are movably supported in a predetermined manner so that they may change their relative positions inside the machine housing 1. The reason for providing these rollers 36, 37 and 38 movable in a predetermined manner is such that the image retention belt 33 may be brought into and out of contact with each of the photosensitive drum 6, the paper transport drum 21 and the application roller 32 as desired. Accordingly, the toner image 40 on the photosensitive drum 6 may be transferred to the image retention belt 33. And, while retaining the transferred image on the belt 33, multiple copies may be made by applying ink by the application roller 32 and conveying the copy paper 14 by the paper transport drum 21 as many times as desired without deteriorating the copy quality. As shown in FIG. 2, the image retention belt 33 comprises a heat-resistant support layer 34 and an elastomer layer 35 overlying the support layer 34. Preferrably, the support layer 34 is made of a polyimide film of 50–200 $\mu$m thickness, and the elastomer layer 35 is made of silicon rubber with the thickness of 25 $\mu$m. A heater 39 is appropriately located along the path of the image retention belt 33. It should be noted that the heater 39 has a dual function of fixing the transferred toner image to the image retention belt 33 and softening the fixed image for easy removal from the image retention belt 33. If desired, however, two separate heaters may be provided for the two different functions.

Now, with reference to FIGS. 2 and 3, an explanation will be had with respect to the process of the present invention when carried out by the apparatus as shown in FIG. 1. At the outset, any conventional electrophotographic technique may be employed to form the toner image 40 on the photosensitive drum 6. The subsequent process generally includes a transfer step (FIG. 2*a*; FIG. 3*a*), a fixing step (FIG. 2*b*; FIG. 3*b*), a printing step (FIGS. 2*c* and 2*d*; FIG. 3*c*) and a cleaning step (FIG. 2*e*; FIG. 3*d*), each of which will be explained in detail hereinbelow.

(1) Transfer Step

Figure 2A:
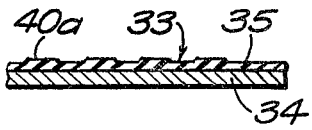
FIGS. 2 (*a*) through (*e*) are diagramatic views showing process steps in accordance with one embodiment of the present invention.
Figure 3A:
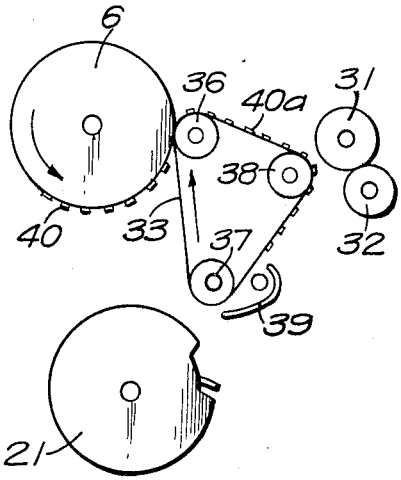
FIGS. 3 (*a*) through (*d*) are diagramatic views showing how the image retention medium interrelates with other components such as a photosensitive drum, an ink application roller and a paper transport drum at each process step in accordance with one embodiment of the present invention.
Figure 3C:
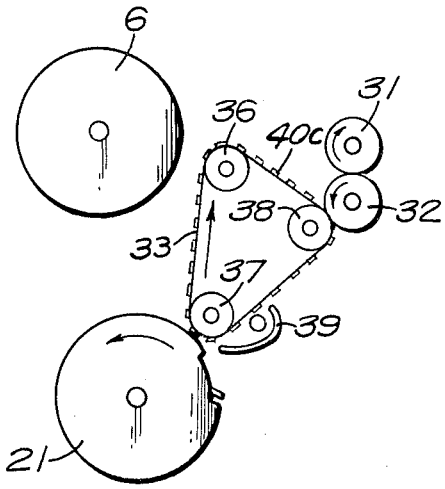

The toner image 40 formed on the photosensitive drum 6 is transferred onto the elastomer layer 35 of the image retention belt 33 as shown in FIGS. 2*a* and 3*a*. The image transfer may be carried out by any conventional technique. As shown in FIG. 3*a*, the pressure contact technique may be used in which the roller 36 is brought into a pressure contact with the photosensitive drum 6 with the belt 33 sandwiched therebetween. Alternatively or in combination, the bias voltage technique may be used in which a voltage is applied between the roller 36 and the drum 6. As best shown in FIG. 3*a*, the other rollers 37 and 38 are shifted to the predetermined positions so that the image retention belt 33 is only in contact with the photosensitive drum 6 under pressure, and not in contact with either of the paper transport drum 21 and the application roller 32. It will be noted that the application roller 32 is shifted to a predetermined position away from the belt 33 in this instance.

(2) Fixing Step

Figure 2B:
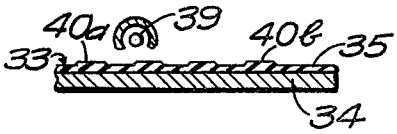
Figure 2C:
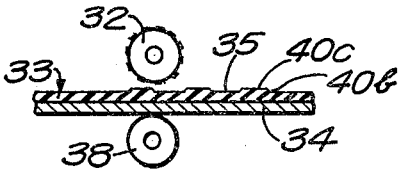
Figure 2D:
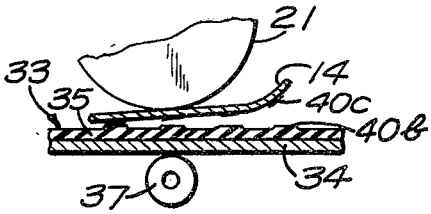
Figure 2E:
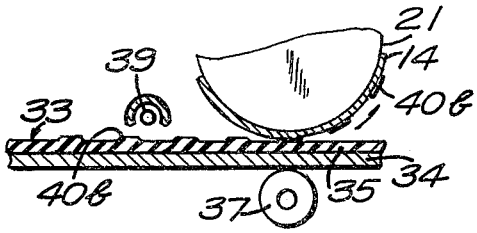
Figure 3B:
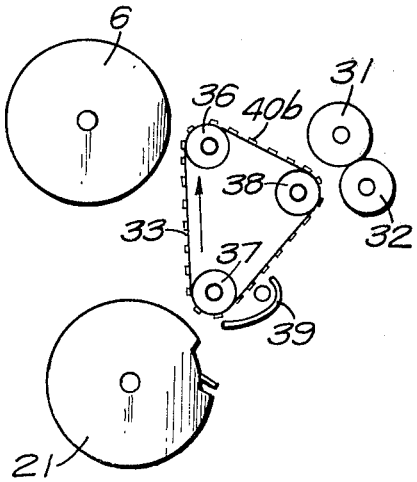
Figure 3D:
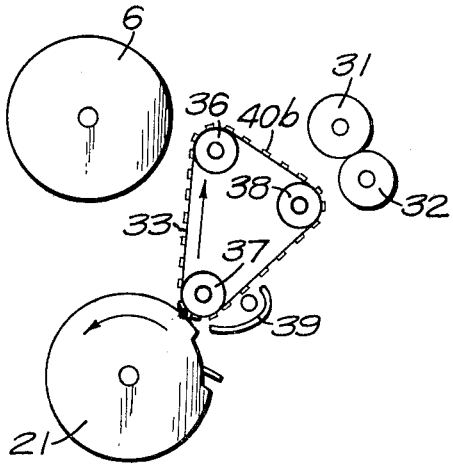

Upon completion of the transfer of the toner image 40 onto the image retention belt 33, the roller 36 is shifted to a predetermined position to bring the belt 33 away from the drum 6 and the heater 39 is rendered operative as shown in FIGS. 2*b* and 3*b*. Therefore, as the belt 33 advances, the transferred toner image 40*a* on the belt 33 successively receives radiant energy from the heater 39 so that the transferred toner image 40*a* is fused and temporarily fixed to the belt 33. It is to be noted that the temperature and the duration of application of heat are appropriately determined depending upon factors such as properties of the toner material and the image retention medium.

(3) Printing Step

After temporarily fixing the transferred toner image 40*b* on the belt 33, the heater 39 is rendered inoperative. The application roller 32 is moved to the position where ink can be applied to the fixed toner image 40*b* on the belt 33; at the same time, the roller 37 is shifted to the position where the ink applied to the toner image may be transferred to the copy paper. In general, the application roller 32 is brought into a pressure contact with the belt 33 and the roller 37 takes the position where the belt 33 is sandwiched between the roller 37 and the drum 21 under pressure. It is to be noted that the roller 38 may be moved instead of the application roller 32.

Since ink is applied to the belt 33 by the application roller 32, an ink image 40*c* is formed on the toner image 40*b*. It will be understood that ink only sticks to the toner material and it does not stick to the non-image area, or the elastomer layer 35. Associated with the advancement of the belt 33, the copy paper 14 is supplied, and, therefore, the paper transport drum 21 is driven to rotate. Thus, as the copy paper 14 is carried as riding on the peripheral surface of the drum 21, the ink image 40*c* is transferred to the copy paper 14. In this manner, an original image is printed on a copy paper 14. Repetitive implementation of this step will produce multiple copies as many as desired. Since the toner image 40*b* is temporarily fixed, there will be no decay nor deterioration of an image. Moreover, since ink is freshly applied to form an ink image 40*c* overlying the fixed toner image 40*b* immediately before the transfer to a copy paper, all of the printed copies are extremely clear and uniform in quality.

(4) Cleaning Step

This is nothing but the final cycle of making the very last copy in the multiple printing operation. In other words, when the next-to-last copy is produced, the application roller 32 is moved back to the original position and it ceases to supply ink to the belt 33. At the same time, the heater 39 is again rendered operative so that the toner image 40*b* so far fixed to the belt 33 becomes softened and transferred to the last copy paper 14. In this instance, the heater 39 may be controlled so as to increase the temperature of the elastomer layer 35 to help remove the toner image 40 from the belt 33. In this manner, the cleaning of the belt 33 is carried out. If desired, a special cleaning paper 41 may be fed instead of an ordinary copy paper 14 in order to increase the cleaning performance. Or, for that matter, a cleaning member such as a cleaning roller or a cleaning web may be provided in the machine housing 1.

As described above, the image retention medium of the present invention may be presented for repetitive use, which is quite advantageous and economical. Moreover, after transferring a toner image to the image retention medium, the photosensitive drum may be left inoperative for the subsequent multiple printing operation, which leads to a significant saving of power. It should also be appreciated that since the toner image is temporarily fixed to the image retention medium, there is no decay nor deterioration of an image, which, in turn, enables multiple copies of the same quality to be produced even if the number of multiple copies is very high.

Incidentally, it may be noticed that no provision is made of a cleaning unit around the periphery of the photosensitive drum 6 in the apparatus shown in FIG. 1. Generally, it is not necessary to provide a cleaning unit because of the following reason. That is, if the roller 36 is pressed against the photosensitive drum 6 with 1 $kg/cm^2$ at the time of the image transfer step, the transfer efficiency is around 80%. The residual toner (20%) on the photosensitive drum 6 will be collected by the magnetic brush of the cleaning unit 12.

The ink 28 may be appropriately selected in consideraton of other factors. It may be either hydrophilic or oily. However, it would be better to use a hydrophilic ink in the embodiment described above, because it will ensure non-stickness between the ink 28 and the elastomer layer 35 and it will also contribute to prevent the copy paper 14 from being electrostatically charged. But, the use of a hydrophilic ink will require the use of a hydrophilic toner. Many toner materials are water-repellent; however there are also hydrophilic toner materials. If desired, a hydrophilic resin may be used to make a hydrophilic toner material. It is interesting to note that a single component toner containing a relatively large amount of iron powder shows a hydrophilic property. So, this indicates that such a single component toner is a possible candidate to be used in the present invention.

It is to be noted that the above description as to the present invention is directed to making a large number of copies. However, this does not exclude the possibility of using the present invention for making a single copy or a few copies. If a single copy is to be made, then the step of FIG. 3*c* may be omitted. Or, the rollers 36 and 37 may be moved to positions so that the belt 33 is only in contact with the photosensitive drum 6 and the paper transport drum 21. Then, the two drums 6 and 21 and the belt 33 are driven to move in synchronism while rendering the heater 39 operative. If desired, the electrophotographic process and the printing process may be operated at different speeds. Each of the process speeds may be so determined to enhance the quality of a reproduced image and to increase the over-all copy speed. In addition, in accordance with the present invention, the exposure lamp 8 and the heater 39 are not operated at the same time, which leads to a relatively low maximum power requirement.

Figure 4:
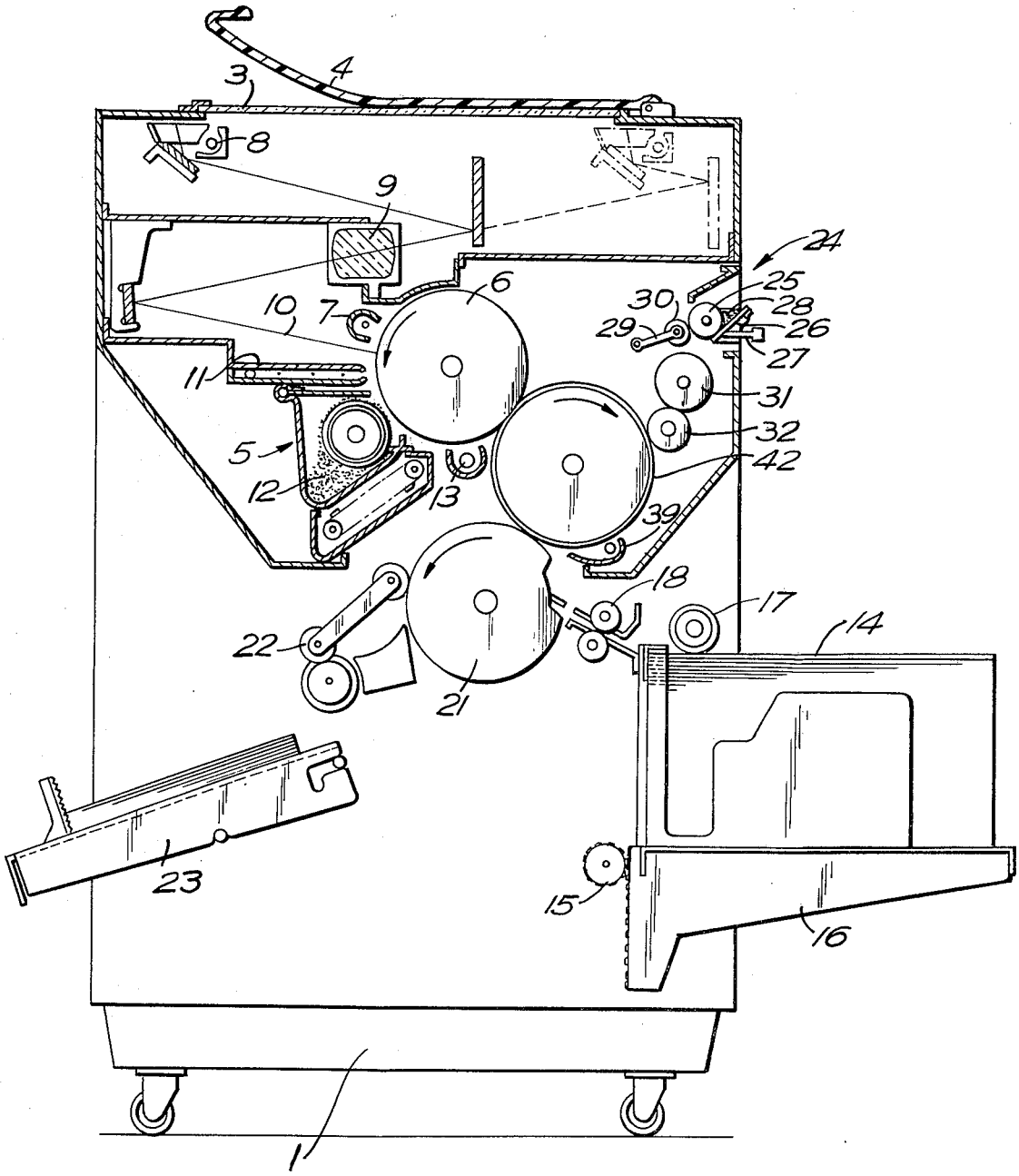
FIG. 4 is a front elevational view showing another embodiment of the present invention.
Figure 5:
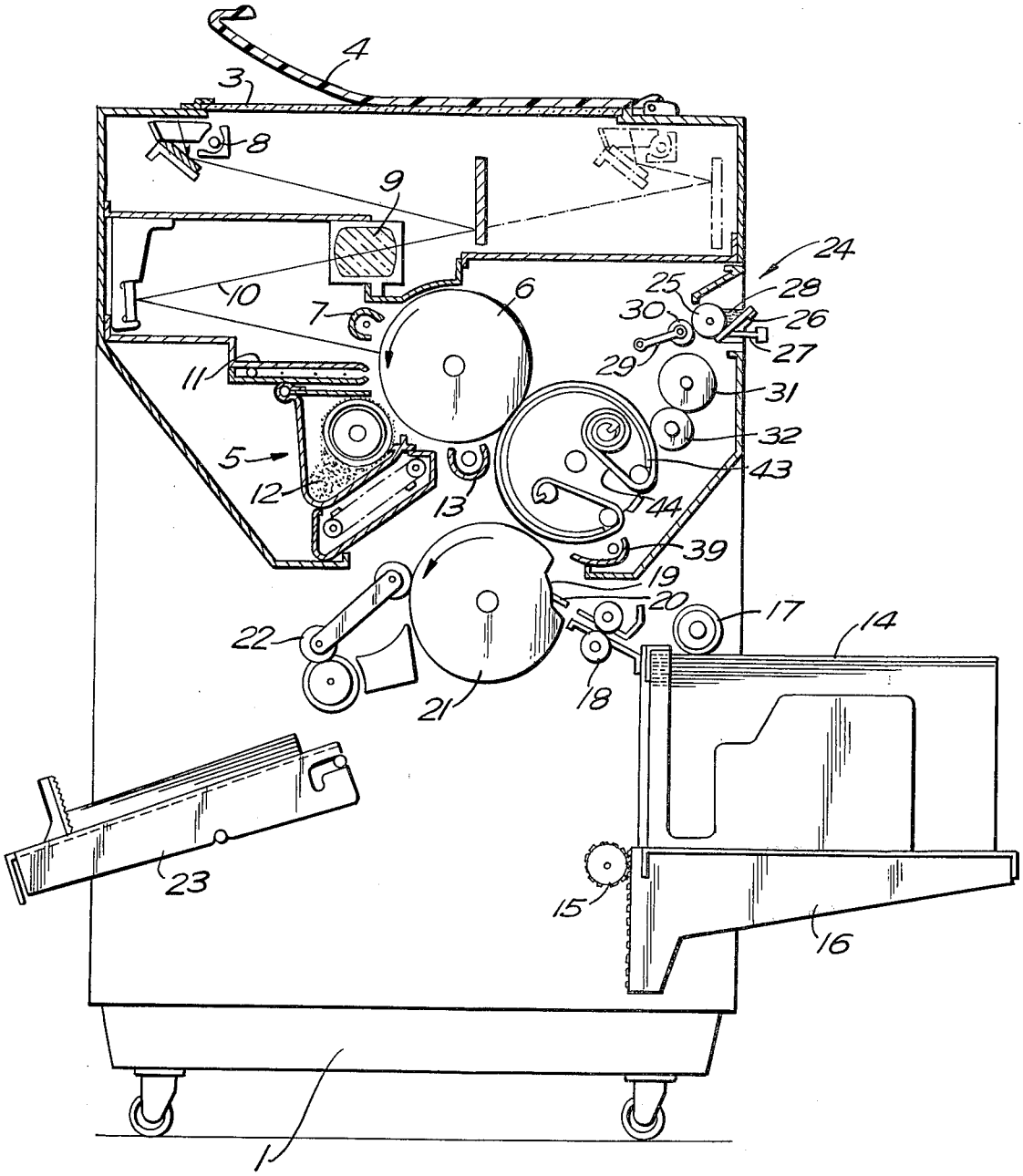
FIG. 5 is a front elevational view showing still another embodiment of the present invention.

Referring to FIGS. 4 and 5 wherein like numerals represent like elements, there are shown other embodiments of the present invention. As shown in FIG. 4, the image retention medium may be in the form of a drum 42. If desired, another heater may be provided inside the image retention drum 42 to increase thermal efficiency at the surface of the drum 42. On the other hand, as shown in FIG. 5, the image retention medium may be in the form of a web 44 which moves along an arc-shaped member 43. In this event, it may be so structured that the web 44 is rewound manually or automatically after making a predetermined number of copies. In addition, it is to be noted that, although use is made of a photosensitive drum in the embodiments described above, a photosensitive member of any other form such as an endless belt or a web may also be employed in the present invention.

While the above provides a full and complete disclosure of the preferred embodiment of the invention, various modifications, alternate constructions and equivalents may be employed without departing from the true spirit and scope of the invention. Therefore, the above description and illustrations should not be construed as limiting the scope of the invention, which is defined by the appended claims.

What is claimed is:

1. A process for making multiple copies comprising the steps of:

forming a toner image on the surface of a photosensitive member through an electrophotographic process;

transferring said toner image onto an image retention medium to form a transferred toner image;

fixing said transferred toner image to said image retention medium to form a fixed toner image; and applying ink to said fixed toner image to form an ink image while transferring said ink image to a copy paper.

2. The process of claim 1 further comprising the step of softening said fixed toner image.

3. The process of claim 2 wherein said softening step is carried out without application of ink, thereby cleaning said image retention medium.

4. The process of claim 1 wherein said toner image transferring step is carried out by a pressure contact between said photosensitive member and said image retention medium.

5. The process of claim 1 wherein said fixing step is carried out by the application of heat to said transferred toner image.

6. The process of claim 2 wherein said softening step is carried out by the application of heat to said fixed toner image.

7. In a process for making a copy in which a toner image is formed on a photosensitive member by the application of charging, exposure of an original image, and developing with toner; said process comprising the steps of:

transferring said toner image into an image retention medium to form a transferred toner image;

applying ink to said transferred toner image to form an ink image; and transferring said ink image to a copy paper.

8. The process of claim 7 wherein said transferred toner image is fixed by the application of heat prior to the ink application step.

9. The process of claim 8 further including the step of cleaning said image retention medium by removing the thus fixed toner image.

10. Apparatus for making multiple copies comprising:

means for making a toner image;

an image retention medium for receiving said toner image on its surface;

means for temporarily fixing said toner image to said image retention medium;

means for applying ink to said toner image thus fixed to said image retention medium; and means for transporting a copy paper to bring said copy paper in contact with said image retention medium.

11. The apparatus of claim 10 wherein said means for making a toner image comprising a photosensitive member, a charger for charging said photosensitive member, an exposure system for exposing an original image onto said photosensitive member thus charged to form an electrostatic latent image, a developing unit for developing said latent image to form a toner image.

12. The apparatus of claim 11 wherein said photosensitive member is in the form of a drum which is rotatably supported, and said charger, exposure system and developing unit are arranged along the periphery of said drum in the direction of rotation of said drum in the order as mentioned.

13. The apparatus of claim 10 wherein said image retention medium is in the form an endless belt extended around a plurality of rotatable rollers.

14. The apparatus of claim 13 wherein at least one of said rollers are movable between two positions to change the position of said endless belt.

15. The apparatus of claim 13 wherein said image retention medium comprises a support layer and an elastomer layer overlying said support layer.

16. The apparatus of claim 15 wherein said support layer is made of polyimide and said elastomer layer is made of silicon rubber.

17. The apparatus of claim 16 wherein said support layer is 50–200 μm thick and said elastomer layer is 25 μm thick.

18. The apparatus of claim 10 wherein said fixing means comprises a heater for applying heat to said toner image.

19. The apparatus of claim 10 wherein said means for applying ink comprises a reservoir for containing ink, an application roller engageable with said image retention medium, and means for supplying ink from said reservoir to said application roller.

20. The apparatus of claim 18 wherein said heater is also used for cleaning said image retention medium.

21. Apparatus for making multiple copies comprising:
a machine housing;
a photosensitive drum rotatable supported by said machine housing;
a series of electrophotographic process units disposed around the periphery of said photosensitive drum, including a charger, an exposure system and a developing device;
an image retention belt supported by a plurality of rollers;
a heater disposed in the vicinity of said image retention belt;
a paper transport drum rotatably supported by said machine housing and provided with a clamper for clamping the leading edge of a copy paper;
means for applying ink to said image retention belt;
means for feeding a copy paper to said paper transport drum;
means for discharging a copy paper from said paper transport drum; and
means for moving said rollers to bring said belt into and out of contact with said photosensitive drum, paper transport drum and ink applying means.

22. The apparatus of claim 21 wherein said ink applying means includes an ink application roller which can be moved into contact with said belt.

23. Apparatus for making multiple copies comprising:
a machine housing;
a photosensitive drum rotatably supported by said machine housing;
a series of electrophotographic process units disposed around the periphery of said photosensitive drum, including a charger, an exposure system and a developing device;
an image retention drum rotatably supported by said machine housing;
a heater disposed in the vicinity of said image retention drum;
means for bringing a copy paper into contact with said image retention drum; and
means for applying ink to said image retention drum.

24. Apparatus for making multiple copies comprising:
a machine housing;
a photosensitive drum rotatably supported by said machine housing;
a series of electrophotographic process units disposed around the periphery of said photosensitive drum, including a charger, an exposure system and a developing device;
an image retention web of a predetermined length;
an arc-shaped member along which said web advances;
means for advancing said web along said arc-shaped member;
a heater disposed in the vicinity of said image retention web;
means for bring a copy paper into contact with said image retention web; and
means for applying ink to said image retention web.

* * * * *